United States Patent [19]

Olsen et al.

[11] Patent Number: 4,536,135

[45] Date of Patent: Aug. 20, 1985

[54] HIGH PRESSURE LIQUID PISTON PUMP

[75] Inventors: John H. Olsen, Vashon; Sigurd C. Mordre, Dockton, both of Wash.

[73] Assignee: Flow Industries, Inc., Kent, Wash.

[21] Appl. No.: 424,206

[22] Filed: Sep. 27, 1982

[51] Int. Cl.[3] ..... F04B 9/10

[52] U.S. Cl. ..... 417/383; 417/437

[58] Field of Search ..... 417/383, 437

[56] References Cited

U.S. PATENT DOCUMENTS

| | | | |
|---|---|---|---|
| 2,075,428 | 3/1937 | Dickson . | |
| 2,497,300 | 2/1950 | Elliott . | |
| 3,087,433 | 4/1963 | Cerveny . | |
| 3,306,042 | 2/1967 | Crooks . | |
| 3,323,467 | 6/1967 | Heintz | 417/454 X |
| 3,338,170 | 8/1967 | Swartz . | |
| 4,304,531 | 12/1981 | Fisher | 417/388 |

FOREIGN PATENT DOCUMENTS

| | | | |
|---|---|---|---|
| 2559240 | 7/1977 | Fed. Rep. of Germany | 417/437 |
| 2739745 | 3/1979 | Fed. Rep. of Germany | 417/437 |
| 2385912 | 10/1978 | France | 417/437 |

OTHER PUBLICATIONS

Jet Cutting Technology, Apr. 6–8, 1982, 6 pages.

*Primary Examiner*—Leonard E. Smith
*Attorney, Agent, or Firm*—Don R. Mollick

[57] ABSTRACT

A piston and a cylinder within a pump housing cooperate with the inner walls of the housing to form a high-pressure reservoir surrounding the cylinder to provide a continuous compressive force thereon to prevent tensile stresses in the cylinder during pumping operations to prevent failure of the cylinder due to metal fatigue. A check valve between the cylinder and the reservoir permits high-pressure fluid to flow from the cylinder into the reservoir during pumping operations to maintain substantially the maximum cylinder pressure within the reservoir. The cylinder further includes therein an inlet with an associated check valve. Stationary seals in the pump use the high pressures in the cylinder and the reservoir for producing the sealing forces necessary to prevent leakage. The primary piston seal consists of a long, controlled clearance gap which permits a small leakage but has only minor contact and thereby low sliding stresses and a long life.

13 Claims, 5 Drawing Figures

HIGH PRESSURE LIQUID PISTON PUMP

BACKGROUND OF THE INVENTION

1. Field of the Invention

This invention relates to fluid pumps, particularly to high pressure fluid pumps, more particularly to high pressure fluid pumps having relatively high cycle speed.

2. Description of Field of Art

A number of types of pumps have been proposed for use in producing flows of high pressure fluid such as that used in fluid jet cutting nozzles. For use in such applications a pump must produce a fluid pressure of at least 20,000 psi with ability to produce pressures of 60,000 psi or greater for greater efficiency. Additionally, the pump should require minimum maintenance and possess a high degree of freedom mechanical failure. While present applications using fluid cutting jets depend on the unique ability of the cutting jet as compared to conventional cutting methods, it is anticipated that a great many new applications would appear if the cost were low.

The primary apparatus proposed to fit the above parameters is the hydraulically driven plunger pump, which is also called an intensifier. Intensifiers require expensive hydraulic drive systems connecting a source of mechanical power and the pumping apparatus. Intensifiers must also be operated at low speed to enhance component life and are, therefore, not usable for high volume production at low cost. The alternate pressurization and depressurization cycles of the intensifier subject the material of which the intensifior is constructed to alternate compression and expansion. This expansion and compression leads to metal fatigue of the cylinder and similar parts within an unacceptable short period of time if greater speeds are attempted. Similarly, the cycle speed must be kept low to preserve the seals used in the intensifier. The great costs of current intensifiers and, particularly, the hydraulic drive system required has limited the use of cutting tools to applications where pump costs are small factors.

It has been proposed that a small pump operating at engine or motor speed would be capable of producing the same output as a low speed intensifier pump without use of a hydraulic drive system. To date, however, the problems of seal wear and metal fatigue have prevented the successful construction of such a pump, let alone the commercialization of such a pump. Accordingly, there is a need for a high speed, ultra high pressure pump not subject to metal fatigue and seal wear.

SUMMARY OF THE INVENTION

The invention provides a high speed, ultra high pressure pump that is capable of sustained operation without maintenance at a lower cost than existing pumps. Metal fatigue is drastically reduced from that present in existing technology.

The invention provides a piston in a cylinder and associated check valves. The piston may be driven by either a crankshaft or cam arrangement without the use of a hydraulic interface. Use of the direct drive allows greater cycling rates and use of a relatively small cylinder and piston. The cylinder is surrounded by a high pressure reservoir. The cylinder is thus under constant compression drastically reducing the possibility of metal fatigue and making the rapid cycle rate possible. The piston is sealed by a dynamic seal which allows rapid movement without errosion yet seals against ultra high pressures. A separator may be added to allow the moving parts to be constantly lubricated by oil.

DESCRIPTION OF THE PREFERRED EMBODIMENT

Figure 1:
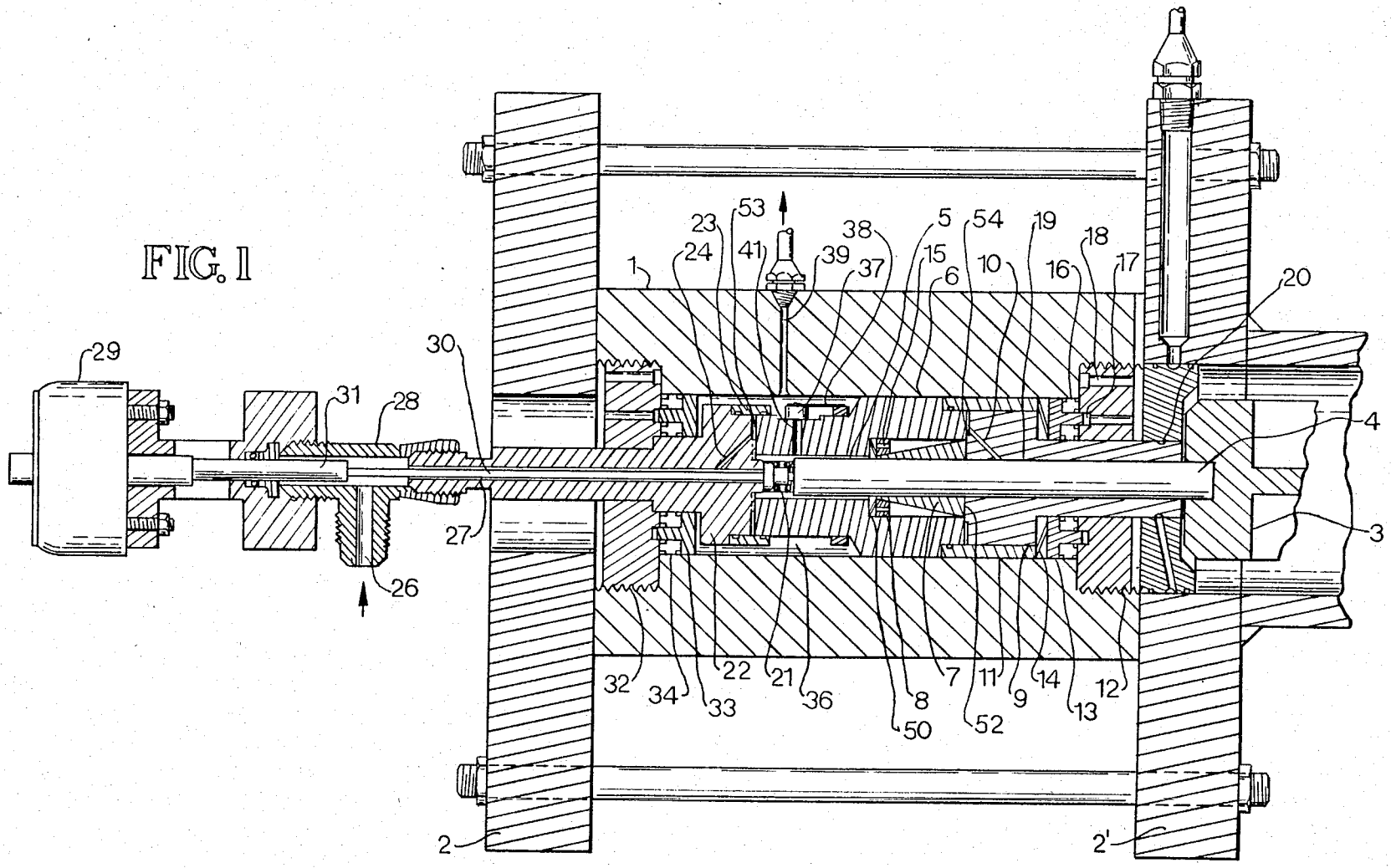
FIG. 1 is a section front elevational view of a first embodiment of the invention.

Referring to FIG. 1, a housing 1 is supported by a pair of frame members 2 and 2'. The housing 1 must be of sufficient strength to withstand the maximum pressure to which the fluid is subjected with an appropriate margin of safety. The housing 1 is a hollow cylinder having an outlet passage 39 and a pair of end caps 12 and 32 threadedly engaged with the housing 1 to close the ends thereof. An actuator 3 transmits force from a power source (not shown) to reciprocate a pump plunger 4 to generate the high-pressure output. The actuator 3 may be powered by a mechanical power source such as a crankshaft, cam, or by any other suitable means. The actuator 3 must exert a force greater than the maximum fluid pressure acting on the area of plunger 4.

The actuator 3 exerts a force which pushes the plunger 4 into cylinder 6 within the housing 1. Cylinder 6 has a central passage 5 therethrough of sufficient size for receiving plunger 4. The inside of the cylinder 6 is further provided with a step to allow cylinder 6 to receive a seal 7. Seal 7 is a hollow truncated conical member with a central passage 5 chosen to seal to plunger 4. From central passage 5 of cylinder 6 fluid pressure is transmitted through a plurality of orifices 15 in an auxillary seal ring 8 to the exterior conical portion of the seal 7. During operation, the very high fluid pressure on the exterior conical portion of the seal 7 presses it toward plunger 4, making an effective seal and urging seal 7 toward a seal retainer 9 to seal the interior portion of cylinder 6 and the high-pressure fluid therein from the outside environment. Seal 7 does not contact plunger 4 during operation the seal being formed as a consequence at the length of seal 7 and the close clearance between seal 7 and plunger 4. The efficiency of seal 7 increases with increasing pressure. To bias seal 7 against seal retainer 9 a bellville spring 50 (or other similar means) is provided between auxillary seal ring 15 and cylinder 6.

To complete the sealing of housing 1 from the exterior environment, the exterior of cylinder 6 must also be sealed. The sealing structure of the invention seals the interior of housing 1 from the outside environment by a series of seals which increase in sealing efficiency when the pressure increases and which are effective for pressures over 40,000 psi. A seal ring 11 seals the exterior portion of the junction of cylinder 6 and seal retainer 9 to control leakage therethrough. Seal ring 11 seals because a first vent 10, a passage 19, and a second vent 20 in the seal retainer 9 vent the interior of the junction of cylinder 6 and seal retainer 9 to the outside environment to create a pressure differential between the interior of the housing 1 and the junction of cylinder 6 and seal retainer 9 when the pump is in operation. This pressure differential provides a compressive force on the exterior of seal ring 11, forcing seal ring 11 onto cylinder 6 and seal retainer 9 thus forming a high-pressure seal between seal ring 11, seal 7 and seal retainer 9. In a similar manner, the force caused by the pressure differential between the interior of housing 1 and the exterior thereof urges a seal element 13 into a sealing passage 17 which is vented to the outside environment, thus compressing a seal holder 16. The seal holder 16 may comprise a series of metal rings embedded in a fluorocarbon polymer support, which deforms when pressure urges seal holder 16 into sealing engagement with seal retainer 9, housing 1 and cap 12. A passage 18 conducts any fluid which leaks past seals 7 and 13 out of housing 1.

A spring 14 between seal element 13 and seal retainer 9 provides the sealing force necessary for proper operation of seals 7 and 13 at low pressures.

The inlet end of the pump is sealed in a manner similar to the actuator end. An inlet check valve 21 is connected to a valve holder 22, which is sealed to cylinder 6 by a seal ring 23 in a similar manner to that used in sealing seal retainer 9 to cylinder 6 by seal ring 11. A passage 24 connects the joint between valve holder 22 and cylinder 6 to the inlet passage 27 in valve holder 22, which is a region of relatively low fluid pressure. Therefore, high pressure fluid around seal 23 exerts a sealing force thereon. A seal holder 34 and a seal element 33 seal housing 1 to a cap 32 in a similar manner to that used to seal seal 16, seal element 13, and seal housing 1 to cap 12. Thus, the interior of housing 1 is completely sealed from the outside environment.

The working fluid enters a T joint 28 at an inlet 26. T joint 28 connects inlet 26 to valve holder 22. An inlet valve controler link 31 connects the inlet valve controler 29 to a valve stem 30, which controls the operation of inlet check valve 21. By controlling the closing of inlet check valve 21 through inlet valve controler 29, the operator may control the pressure and volume of the output of the pump. This is because when controler 29 is activated valve 21 does not function as a check valve and pumping action is eliminated. When cylinder 6 is filled, the inlet valve 21 closes. The actuator 3 then moves plunger 4 inward to pressurize th fluid contained within cylinder 6, and the high-pressure fluid opens a poppet valve 37 to allow fluid to flow through a cylinder outlet passage 41 into the reservoir 36. A leaf spring 38 connected between poppet valve 37 and cylinder 6 permits poppel valve 37 to function as a cylinder outlet check valve, which opens when the pressure in cylinder 6 exceeds the pressure in reservoir 36 by a predetermined amount. After passing poppet valve 37, the high-pressure fluid fills reservoir 36 from which high-pressure fluid may be drawn on demand through the pump outlet 39. When a pressure stroke is completed, the plunger 4 begins an inlet stroke, valve 21 opens; and the cycle repeats.

Fundamental to understanding the operation of the invention is knowledge of the functions of reservoir 36. The high-pressure fluid contained within reservoir 36 provides the forces necessary for proper high-pressure operation of seals 33, 23, 11 and 13 and valve 37 in the manner described above. Reservoir 36 encloses cylinder 6, thus placing the cylinder 6 under continuous compressive loading, preventing occurence of tensile stresses during intake and pressure strokes, respectively, of the plunger 4. Metal fatigue of the walls and passages in cylinder 6 is thus reduced. Therefore, reservoir 36 controls pressure differentials across the walls of cylinder 6 to maintain the structural integrity thereof and to allow operation at a rapid cycling rate. Reservoir 36 also evens out fluctions in fluid pressure, which are inherent in all piston pumps which do not use an external accumulator to provide an output having a constant pressure.

A step 53 on the surface of inlet housing 22, and a step 54 on the surface of seal retainer 9, aid in holding the assembly together. Steps 53 and 54 produce areas of low relative pressure in their vicinity as they are vented to inlet 30 via vent 24 and the clearance around plunger 19 via vent 10, respectively. This results in a force urging inlet housing 22 and seal retainer 9 toward cylinder 6. Due to the presence of steps 53 and 54, a metal to metal contact zone is produced between seal retainer 9 and cylinder 6, as well as between cylinder 6 and inlet housing 22. This metal to metal contact, combined with the resultant force, seals the assembly together with a force that increases as the pressure in housing 1 increases. The areas of the metal to metal contact are chosen to be sufficiently small to produce a high contact stress needed for proper sealing at operating pressures.

Figure 2:
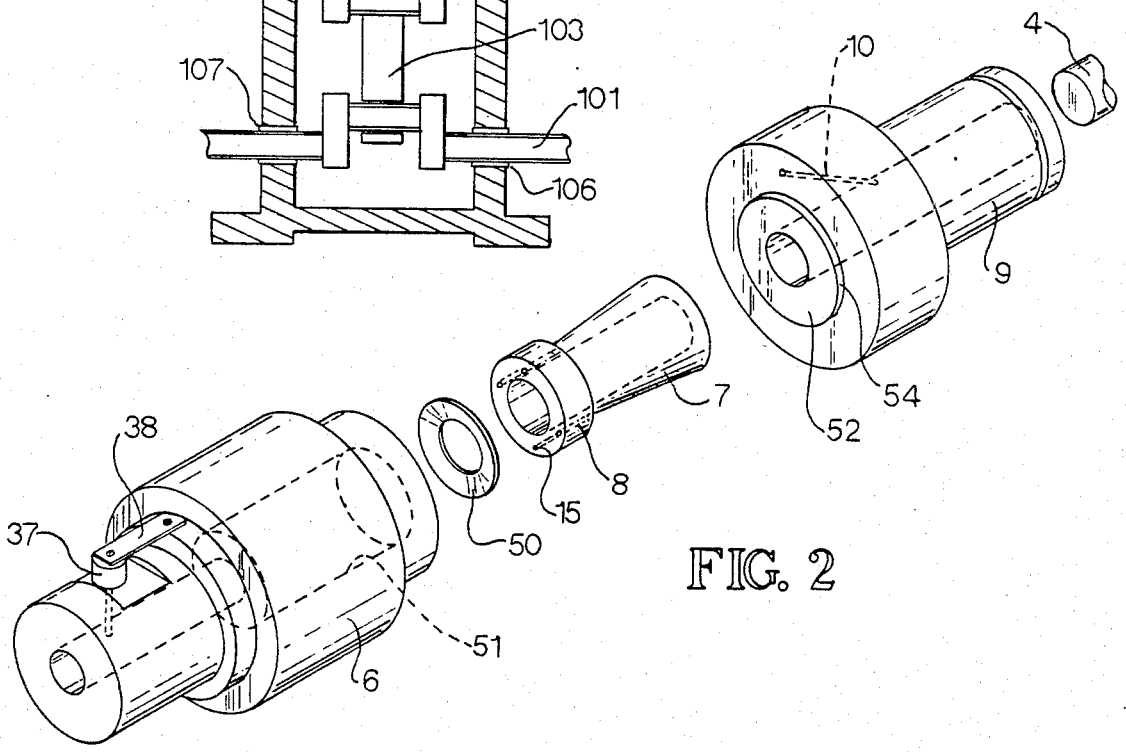
FIG. 2 is an exploded isometric view of the FIG. 1 embodiment.

FIG. 2 is an exploded isometric view which further illustrates the structural relationships of seal 7, cylinder 6 and seal retainer 9. Seal 7 is a hollow truncated conical member with an inside diameter that initially is about 0.001" larger than the outside diameter of plunger 4. The pressure differential between the fluid in cavity 51 and the pressure present at the interior of seal 7 radially compresses the seal 7 toward plunger 4 to reduce the clearance and simultaneously urge seal 7 toward a seat 52 to form a seal that increases in efficiency as the fluid pressure increases within cylinder 6. A vent 10 provides a reduced pressure at step 54 between seal holder 9 and the cylinder 6 as it connects to the outside environment via the clearance between seal retainer 9 and plunger 4.

Figure 3:
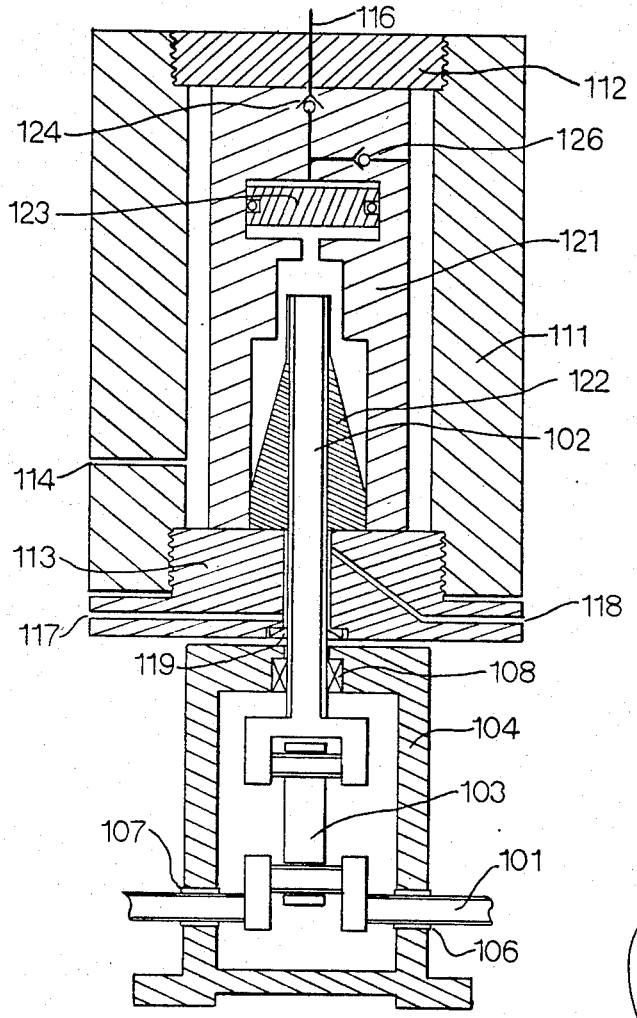
FIG. 3 is a schematic front elevation view of a second embodiment of the invention.

FIG. 3 is a schematic view of a second embodiment of the invention which allows for primary (water) and secondary (oil) fluids. A motor (not shown) is connected to a crankshaft 101. Typical motor speeds are in the range of 1,000–5,000 rpm which are attainable with electric, diesel, or gasoline engines. Accordingly, it is anticipated that crankshaft 101 could be directly connected to the motor which would have a fly wheel to eliminate loading effects. Crankshaft 101 is connected to a plunger 102 by a connecting rod 103 in a manner similar to that used in internal combustion engines. The assembly is contained in housing 104 which provides mounting for bearings 106, 107 and 108 as well as a containment for lubricants. Crankshaft 101 and the linkage could also be replaced with a camshaft and tappet for certain applications. While only one cylinder is shown, it is anticipated that future pumps could have multiple cylinders connected to a common crankshaft.

In this embodiment all high pressure parts are enclosed in a housing 111 which functions as an accumulator. Housing 111 is closed at either end by end caps 112, 113. An outlet 114 penetrates housing 111 allowing withdrawal of high pressure fluid. End cap 112 is penetrated by fluid inlet 116 which is connected to a source of low pressure fluid (not shown). End cap 113 is penetrated by plunger 102 and a low pressure oil inlet 117 and an oil outlet 118. Oil is constantly circulated through inlet 117 and out outlet 118. An oil seal 119 is provided to prevent leakage of low pressure oil around plunger 102. The cylinder 121 is located inside housing 111. A dynamic seal 122, which also acts to control oil pressure, seals the interior of cylinder 121 from the low pressure area. Cylinder 121 is designed to be under constant compression as described in the FIG. 1 embodiment. A separator 23 in cylinder 121 provides an interface between the oil and the pumped primary fluid systems. Finally, an inlet check valve 124 and an outlet check valve 126 in cylinder 121, serving the primary fluid, complete the pump necessities.

One cycle of operation will be described to clarify operations. As plunger 102 is drawn toward crankshaft 101 the oil pressure in cylinder 121 is reduced causing separator 123 to also move toward crankshaft 101. The volume above separator 123 is thus increased causing inlet check valve 124 to open and allow the filling of the area above separator 123 with primary fluid from inlet 116. If oil has been lost through leakage, additional oil will be drawn from the circulating oil into the interior of cylinder 121 to replace the amount lost by lifting dynamic seal 122 which thus functions as a check valve. Dynamic seal 122 will open because there is insufficient oil to fill cylinder 121 when plunger 102 retracts. When plunger 102 is at its extreme out position, the area above separator 123 will be filled with primary fluid and the remainder of cylinder 121 with oil. Plunger 102 now reverses movement and is pushed back into cylinder 121. The oil is then forced into the area below separator 123 forcing separator 123 upward. The resulting increase in pressure of fluid above separator 123 closes inlet check valve 124 and opens outlet check valve 126. Fluid then flows from the area above separator 123 past outlet check valve 126 into the accumulator area between the outside of cylinder 121 and the inside of housing 111. The cycle then repeats and continues until all of the accumulator area is filled with high pressure fluid. High pressure fluid may be withdrawn through high pressure outlet 114 to a load (not shown).

Figure 4:
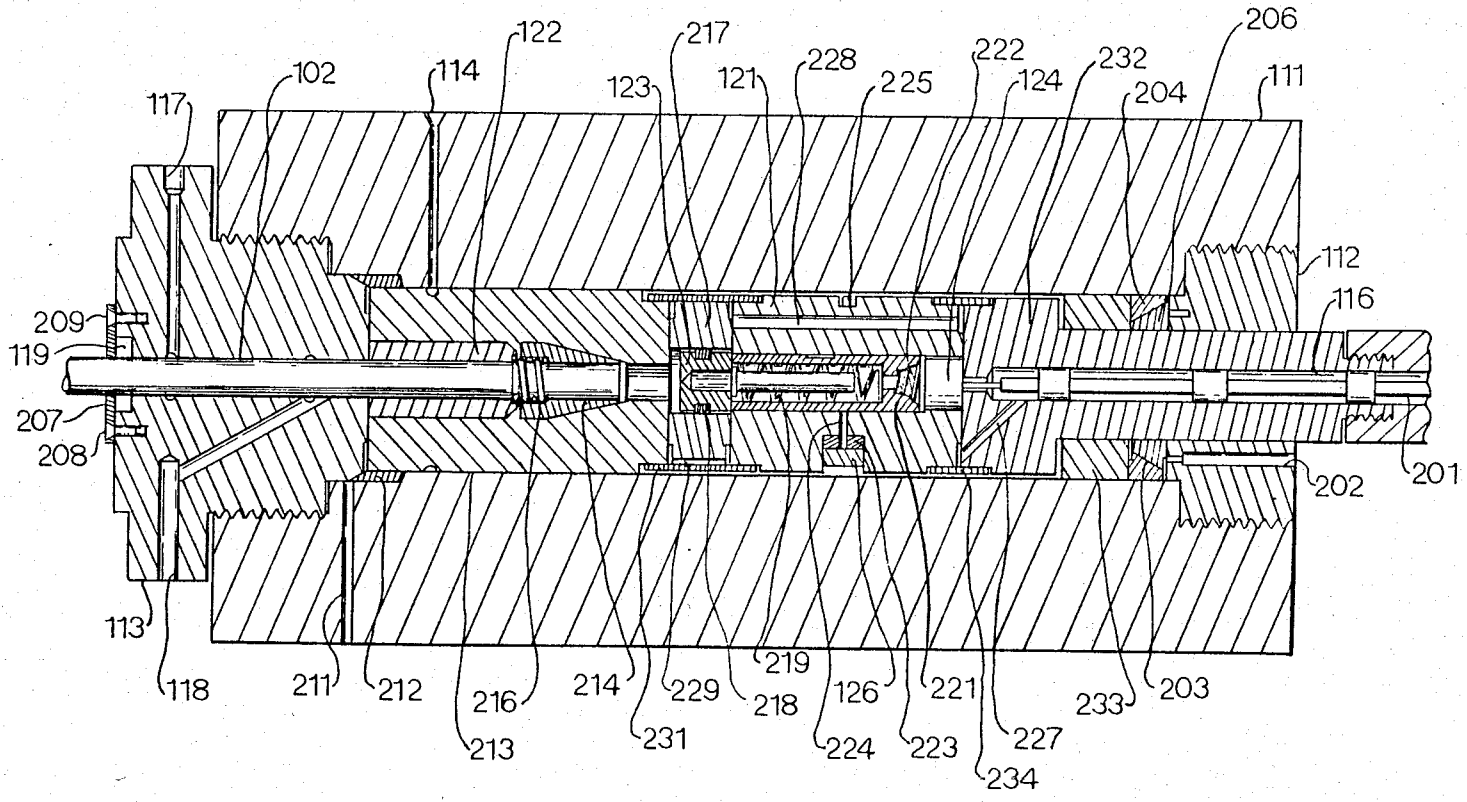
FIG. 4 is a front elevation section view of the FIG. 3 embodiment.

FIG. 4 is a section elevation view of the FIG. 3 embodiment with the same reference numerals indicating identical components. The housing 111 is closed at either end by an inlet end cap 112 and a plunger end cap 113 which are preferably threadably mounted to housing 111. Inlet end cap 112 is pierced by inlet body 232 which contains feed water inlet 116. A valve stem 201 is passed through inlet 116 to control the operation of inlet check valve 124 much as in the FIG. 1 embodiment. A vent 202 also pierces end cap 112 to provide an area of low pressure to aid in the operation of the inlet end seal 203. Inlet end seal 203 is comprised of two elements 204, 206 which adjoin at an angled surface. The pressure differential between the interior of housing 111 and vent 202 causes element 204 to be forced outward into sealing engagement with housing 111 and element 203 to be forced inward into sealing engagement with inlet 116 as well as against element 204 to effectively seal the interior of housing 111 against the outside environment. The effectiveness of seals 203 and 204 increases as the pressure in housing 111 increases. Plunger end cap 113 is threadably attached to the other end of housing 111. Plunger end cap 113 is pierced by plunger 102. Leakage of low pressure oil around plunger 102 is prevented by oil seal 119. Oil seal 119 is retained in a recess in plunger end cap 113 by a seal retainer 207 and screws 208, 209. Plunger end cap 113 is also pierced by oil inlet 117 and oil outlet 118 whose function is described above in the FIG. 3 description. Housing 111 is pierced by the high pressure outlet 114 and a vent hole 211. Vent hole 211 connects the outside environment to the junction of plunger cap 113 and housing 111. Vent hole 211 produces an area of low relative pressure on the plunger end cap side of a seal 212. Seal 212 is a tapered annulus which is thus forced into a sealing engagement with housing 111, plunger end cap 113 and a seal housing 213. The dynamic seal and oil check valve 122 is housed in seal housing 213. A spacer 214 and spring 216 causes dynamic seal 122 to function as in the description of FIG. 3. The separator 123 is housed in a separator cylinder 217 to which it is sealed by separator seal 218. Separator seal 218 may be simple as there is little difference in pressure between the oil on the plunger side of separator 123 and the primary fluid on the inlet side of separator 123. Separator 123's freedom of action toward plunger 102 is limited by seal housing 213 and the movement toward inlet 116 is limited by cylinder 121. Separator 123 is biased toward plunger 102 by a spring 219 contained in a spring spacer 221. A second spring 222 connects spring spacer 221 to inlet check valve 124 and biases inlet check valve 124. The cylinder 121 houses springs 219, 222, spacer 221, and valves 124, 126. Cylinder 121, separator cylinder 217, seal housing 213, and inlet body 232 are separate pieces to further prevent metal fatigue and ease fabrication. Cylinder 121 includes a recess for outlet check valve 126 and the associated check valve seal 223. A check valve passage 224 connects the interior of cylinder 121 and check valve 126. An outlet check valve spring 225 biases outlet check valve 126. A series of passages 227, 228 and 229 connect the joints between components to inlet 116 which is an area of low pressure. Passage 227 through inlet body 232 connects the junction of inlet body 232 and cylinder 121 to inlet 116. Passage 228 through cylinder 121 connects the junction of cylinder 121 and inlet body 232 to the junction of cylinder 121 and separator cylinder 217. Finally, passage 229 through separator cylinder 217 connects the junction of separator cylinder 217 and cylinder 121 to the junction of separator cylinder 217 and seal housing 213. The areas of low pressure at the above junctions cause the separator ring seal 231 and the inlet ring seal 234 to be urged toward spring spacer 221 by the high pressure present in the interior of housing 111. Separator ring seal is forced into sealing engagement with seal housing 213 and cylinder 121 and inlet ring seal 234 is forced into sealing engagement with inlet body 232 and cylinder 121. A spacer 233 completes the description of this embodiment.

Figure 5:
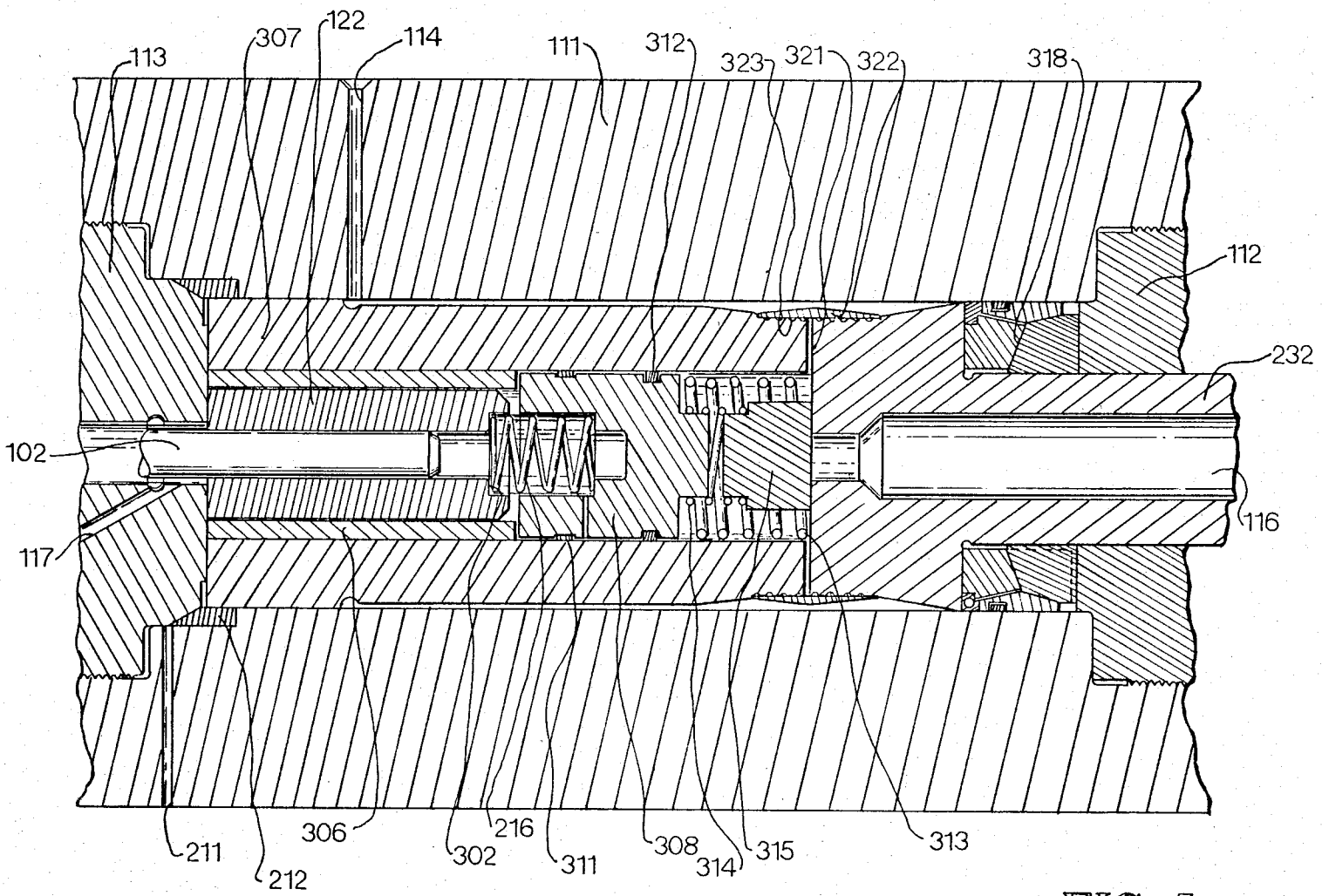
FIG. 5 is a front elevation section view of a 3rd embodiment of the invention.

FIG. 5 is a section elevation detail of a third embodiment of the invention. Components 102, 111, 113, 114, 116, 117, 122, 211, and 212 are identical in design and operation to the same components in the FIG. 4 embodiment. The dynamic seal 122 including a recess 302 for a spring 304, seals to plunger 102 and end cap 113. A spacer 306 separates dynamic seal 122 from a cylinder 307. Spacer 306 also serves to stop the freedom of movement of the separator 308. Dynamic seal 122 is biased in its check valve action by spring 303 contained between recess 302 and a recess 309 in separator 308. Separator 308 forms a barrier between oil adjacent to plunger 102 and primary fluid in the vicinity of inlet 116. Separator 308 is provided with recesses to accept a bearing 311 and a seal 312. Bearing 311 may be a split ring bearing and seal 312 may be any type of resilient seal as the pressure differential between oil and pumped fluid is never large. Separator 308's action is biased by a spring 313 located between inlet body 232 and separator 308. A second spring 314 biases the action of an inlet check valve 15. Spring 314 is located between check valve 315 and separator 308. A polygonal, self-pressurizing seal 318 seals housing 111 to inlet body 232 and inlet end cap 202.

An outlet passage 321, which is actually a series of grooves in the surface of cylinder 307, connects the area between separator 308, cylinder 307 and inlet body 232 to the outlet check valve 322. In this embodiment there are eight such outlet passages spaced evenly like spokes of a wheel. The number of outlet passages 321 may vary depending on the specific applications. Check valve 322 is a sleeve type check valve in this embodiment. Valve 322 utilizes a thin walled circumferential sleeve. The material used for valve 322 is selected with regard to its elasticity to open and close at selected pressure differentials by expansion or contraction of its diameter. When the pressure inside cylinder 307 exceeds that inside housing 111, a force is generated which expands sleeve valve 322. When the pressure inside housing 111 exceeds that inside cylinder 307, the resultant force contracts sleeve valve 322 onto cylinder 307 and inlet housing 232 into a sealing relationship. A series of radial grooves 323 enable further control of valve 322's operation and the spacing thereof may be varied for specific applications.

Although the present invention has been described with reference to particular embodiments thereof, it will be understood by those skilled in the art that modifications may be made without departing from the scope of the invention. Accordingly, all modifications and equivalents which are properly within the scope of the appended claims are included in the present invention.

What is claimed is:

1. A pump, comprising:

a housing;

inlet means for admitting fluid into said housing;

fluid pressurizing means within said housing in communication with said inlet means for pressurizing fluid received therefrom;

said fluid pressurizing means having wall means with internal and external wall surfaces, wherein said fluid pressurizing means includes a cylinder within said housing defined by said wall means, said cylinder being in fluid communication with said inlet means; a piston slidable within said cylinder for pressurizing fluid therein; and means for actuating said piston to provide an intake stroke for admitting fluid into said cylinder and a pressure stroke for pressurizing fluid within said cylinder; and wherein said means for controlling the pressure differential on said wall means includes reservoir means around the exterior surface thereof; and means for providing fluid communication between the interior of said cylinder and said reservoir, whereby high-pressure fluid within said reservoir means provides a compressive force on said wall means to control the pressure differential thereacross as said piston moves between said intake stroke and said pressure stroke;

means for conducting a high-pressure fluid output from said housing and said fluid pressurizing means; and, means for controlling the fluid pressure differential acting on said wall surfaces, whereby stress on said wall means is controlled to prevent structural fatiguing thereof; and, a separator in a housing between said piston and said inlet for isolating said pumped fluid from a second fluid wherein the area between said separator housing and said cylinder is vented to said inlet to urge said separator housing toward said cylinder.

2. A pump according to claim 1 wherein the area between said inlet and said cylinder is vented to said inlet to urge said cylinder toward said inlet.

3. A pump according to claim 1 where said means for providing fluid communication includes check valve means for permitting pressurized fluid within said cylinder to flow into said reservoir means and for preventing high-pressure fluid flow from said reservoir means into said cylinder.

4. A pump according to claim 3 further including means for biasing said check valve means such that said check valve means opens to permit fluid flow from said cylinder into said reservoir when pressure in said cylinder exceeds the pressure in said reservoir by a predetermined amount.

5. A pump according to claim 1 further including seal means between said piston and said cylinder means for providing a seal to control fluid leakage therebetween, said seal means including a seal body, said seal body having a central passage therein for permitting passage of said piston therethrough; and means communicating high-pressure fluid from the interior of said cylinder to the exterior of said seal body, whereby said high-pressure fluid exerts a radially compressive force on said seal body to form a high-pressure seal which increases in sealing efficiency as the pressure thereon increases.

6. A pump according to claim 5 further including a seal retainer between said cylinder and said housing means, said seal retainer having a seat thereon for sealing engagement with the end adjacent said seal retainer of said seal body; and means for venting the junction of said seal retainer and said cylinder such that the high fluid pressure within said housing exerts a sealing force urging said seal body against said seat.

7. A pump according to claim 1 wherein said piston is adapted to operate in a lubricating fluid.

8. A pump according to claim 7 further comprising an oil seal in said housing to prevent leakage of lubricating fluid around said piston.

9. A pump according to claim 7 further comprising seal means between said piston and said housing for providing a seal to control leakage of a lubricating fluid.

10. A pump according to claim 9 wherein said seal means is provided a degree of freedom of movement to control the volume of a lubricating fluid between said piston and said separator.

11. A pump according to claim 10 further comprising an elastic member between said seal and said cylinder for biasing said seal.

12. A pump according to claim 1 further comprising a separator housing for said separator and means for sealing to said cylinder.

13. A pump according to claim 12 wherein said means for sealing is a ring seal.

* * * * *